US007263319B2

(12) United States Patent
Ikeda

(10) Patent No.: US 7,263,319 B2
(45) Date of Patent: Aug. 28, 2007

(54) DEVELOPING DEVICE AND IMAGE FORMING APPARATUS FOR SUPPRESSING TONER-CLUMPS

(75) Inventor: Takashi Ikeda, Tagata-gun (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 283 days.

(21) Appl. No.: 10/863,242

(22) Filed: Jun. 9, 2004

(65) Prior Publication Data

US 2005/0276635 A1 Dec. 15, 2005

(51) Int. Cl.
*G03G 15/09* (2006.01)

(52) U.S. Cl. ..... 399/273

(58) Field of Classification Search ..... 399/279, 399/283, 273

See application file for complete search history.

(56) References Cited

U.S. PATENT DOCUMENTS

| | | | | |
|---|---|---|---|---|
| 4,579,442 | A * | 4/1986 | Minejima | 399/273 |
| 4,632,535 | A * | 12/1986 | Nagata | 399/283 |
| 4,660,958 | A * | 4/1987 | Egami et al. | 399/273 |
| 4,745,429 | A * | 5/1988 | Mukai et al. | 399/283 |
| 5,768,666 | A * | 6/1998 | Ito et al. | 399/273 |
| 5,794,109 | A * | 8/1998 | Ota et al. | 399/279 |
| 5,805,965 | A * | 9/1998 | Tsuda et al. | 399/279 |
| 6,381,434 | B1 * | 4/2002 | Yamamoto | 399/283 |
| 6,658,228 | B2 * | 12/2003 | Wada | 399/273 |
| 2001/0038761 | A1 * | 11/2001 | Ochiai | 399/283 |
| 2003/0138274 | A1 * | 7/2003 | Yamashita | 399/273 |

FOREIGN PATENT DOCUMENTS

JP 10-239966 A 9/1998

* cited by examiner

*Primary Examiner*—Susan Lee
(74) *Attorney, Agent, or Firm*—Foley & Lardner LLP

(57) ABSTRACT

A developing device and an image forming apparatus equipped with the developing device are provided to suppress the deterioration in picture quality of an image formed on a sheet due to toner-clump created in a developer vessel. The developing device includes a developing roller adapted to hold toner thereon while rotating and to supply the toner onto a photosensitive surface of a photosensitive body and a toner recovery vessel adapted to accommodate the developing roller therein with facing an opening portion thereof and to supply the toner to be held on the developing roller onto the developing roller while recovering residual toner remaining on the developing roller. The toner vessel including a protrusion portion protruded toward a roller surface of the developing roller. The protrusion portion is provided at an inner wall part which confronts the roller surface of the developing roller and where the residual toner begins to drop from the developing roller.

8 Claims, 5 Drawing Sheets

| PROTRUDING AMOUNT: h(mm) | PROTRUDING WIDTH(°) 20 | 15 | 10 | 5 | 0 | −5 | −10 |
|---|---|---|---|---|---|---|---|
| 0 | × | × | × | × | × | × | × |
| 0.3 | × | × | × | × | × | × | × |
| 0.5 | × | × | △ | △ | △ | △ | △ |
| 0.7 | × | × | ○ | ○ | ○ | ○ | △ |
| 1 | × | × | × | ○ | ○ | ○ | △ |
| 1.3 | × | × | × | × | ○ | ○ | ○ |
| 1.6 | × | ■ | × | × | × | × | ○ |

FIG.4

| PROTRUDING AMOUNT: h(mm) | PROTRUDING WIDTH(°) −10 | −5 | 0 | 5 | 10 | 15 | 20 |
|---|---|---|---|---|---|---|---|
| 0 | × | × | × | × | × | × | × |
| 0.3 | × | × | × | × | × | × | × |
| 0.5 | △ | △ | ○ | ○ | ○ | ○ | ○ |
| 0.7 | △ | △ | ○ | ○ | ○ | △ | △ |
| 1 | △ | ○ | ○ | ○ | ○ | △ | △ |
| 1.3 | ○ | ○ | ○ | ○ | ○ | △ | ▲ |
| 1.6 | ○ | ○ | △ | △ | △ | ▲ | ▲ |

FIG.5

DEVELOPING DEVICE AND IMAGE FORMING APPARATUS FOR SUPPRESSING TONER-CLUMPS

BACKGROUND OF THE INVENTION

1. Field of the Invention

The present invention relates to a developing device and an image forming apparatus equipped with the developing device.

2. Description of the Related Art

In a traditional image forming apparatus, the following procedures are carried out: an electrostatic latent image is formed on a photosensitive surface of a photosensitive drum as an image carrier followed by developing the latent image to be made visible on the photosensitive surface as a toner image by a developing device using a developer containing toner therein. Subsequently, the toner image is transferred to a paper, and that transferred toner image is fixed on the paper.

FIG. 6 is schematic diagram illustrating an internal configuration of the traditional image forming apparatus.

As shown in FIG. 6, there are disposed in proximity to the circumference of a photosensitive drum 103: an electrical charger 104; an exposure portion (not shown); a developing device 106J; a transfer portion 111; a fresh toner supply portion 115; and a cleaner portion 116.

The developing device 106J is disposed downstream of an irradiation position along a moving direction of the photosensitive surface of the photosensitive drum 103 and accommodates a two-component developer (Hereinafter, referred to simply as a "developer") in a developer vessel 20 so as to supply the developer to the photosensitive surface of the photosensitive drum 103 by a developing roller 27. In this manner, an electrostatic latent image formed on the photosensitive surface of the photosensitive drum 103 is made visible for forming the toner image thereon.

More specifically, the developing roller 27 is configured to hold the developer on its surface (or a roller surface) by magnetic force. The magnetic force is distributed on the roller surface so as to be strong at a position (i.e., in the vicinity of a developing position confronting the photosensitive drum 103) where the retention of the developer is required and so as to be weak at a position (a so-called "recovery pole") where the developer that is residual on the roller surface after a developing process should be disengaged from the roller surface.

With this configuration, the developer residual (or remaining) on the roller surface of the developing roller 27 after the developing process is dropped downwardly by gravity as it moves to approach the position at which the magnetic force on the roller surface is weak. The resultant dropped developer is again supplied to the developer roller 27 as being agitated by a first mixer 24*a*.

In the developing device thus described above, the toner tends to be deposited within the developer vessel 20, especially on a position which is located or provided on an inner wall part which is located in the developer vessel and which confronts the roller surface of the developing roller 27 and where the toner begins to drop from the developing roller 27 during rotation thereof. Thus, when the toner is deposited in a certain amount and subjected to various stresses, a toner-clump is often generated due to such a deposited toner.

When such a toner-clump is being subjected to vibrations during the loading or unloading of the developing device, the toner-clump is dropped from its deposition position into normal developer which does not contain any toner-clump, and mixed with each other. If the toner-clump is transported onto the photosensitive surface of the photosensitive drum 103 by the developing roller 27, it disadvantageously results in deterioration in picture quality (a so-called "clump-fog") on the image formed on the paper sheet material. That is, it is believable that the toner-clump contributes to this deterioration.

SUMMARY OF THE INVENTION

In order to overcome these problems as described above, a developing device and an image forming apparatus equipped with that developing device are provided according to an embodiment of the present invention. That is, an object of the present invention is to suppress the deterioration in picture quality of an image formed on a sheet due to a toner-clump created in a developer vessel.

In view of the above-mentioned problems, the developing device according to the embodiment of the present invention, comprising:

a developing roller adapted to hold toner thereon while rotating and to supply the toner onto a photosensitive surface of a photosensitive body;

a toner recovery vessel adapted to accommodate the developing roller therein with facing an opening portion thereof and to supply the toner to be held on the developing roller onto the developing roller while recovering residual toner remaining on the developing roller; and the toner vessel including a protrusion portion protruded toward a roller surface of the developing roller, the protrusion portion being provided at an inner wall part which confronts the roller surface of the developing roller and where the residual toner begins to drop from the developing roller.

BRIEF DESCRIPTION OF THE DRAWINGS

FIG. 4 is a table for explaining influence on picture quality of an image formed on a sheet upon variation of protruding amount and protruding width of the protrusion portion T;

FIG. 5 is a second table for explaining influence on picture quality of the image formed on the sheet upon variation of protruding amount and protruding width of the protrusion portion T.

PREFERRED EMBODIMENT OF THE PRESENT INVENTION

Hereinafter, an embodiment according to the present invention will be described in detail with reference to the accompanying drawings.

Figure 1:
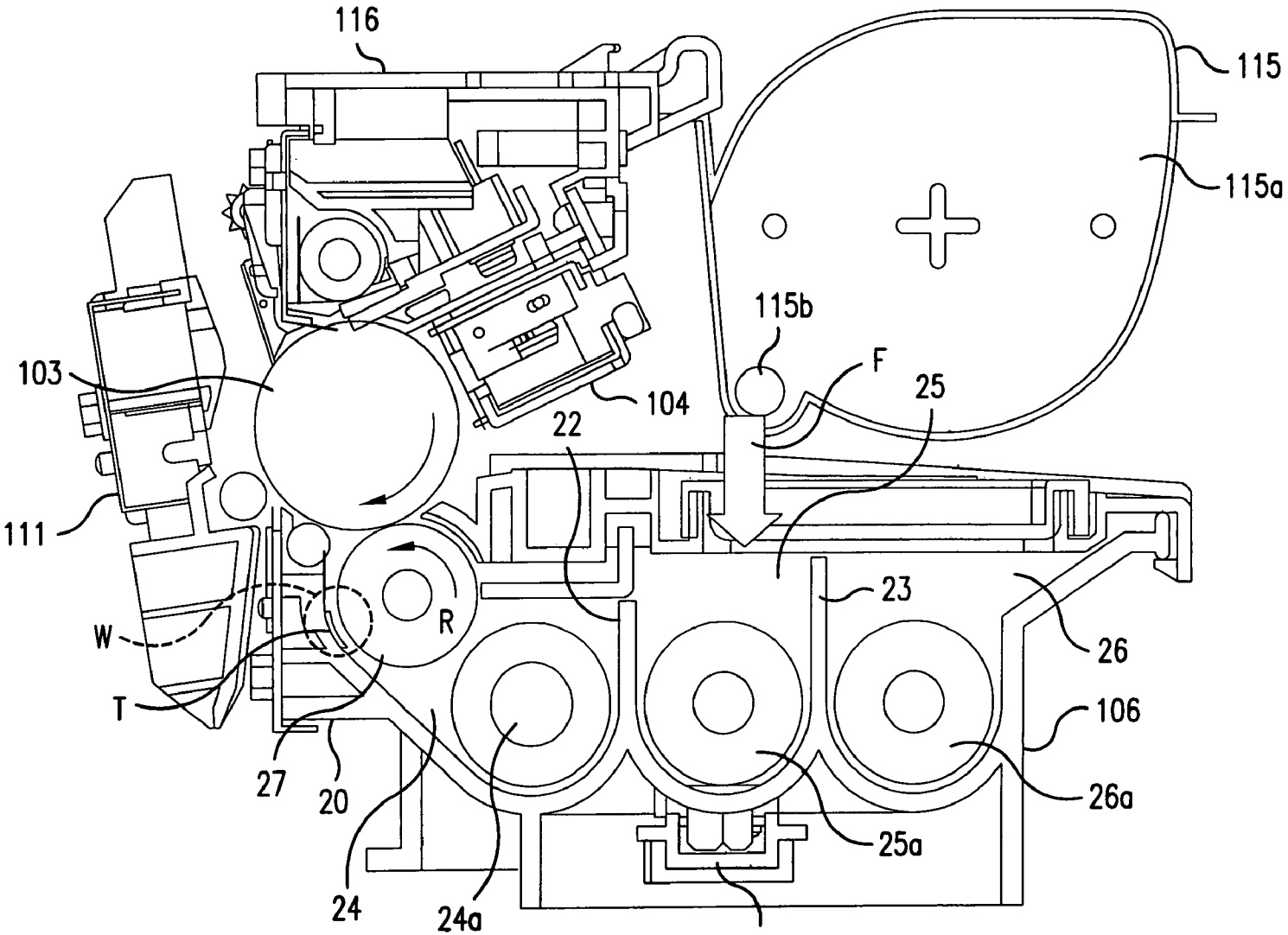
FIG. 1 is a schematic sectional view showing a developing device and an image forming apparatus equipped with that developing device according to an embodiment of the present invention.
Figure 2:
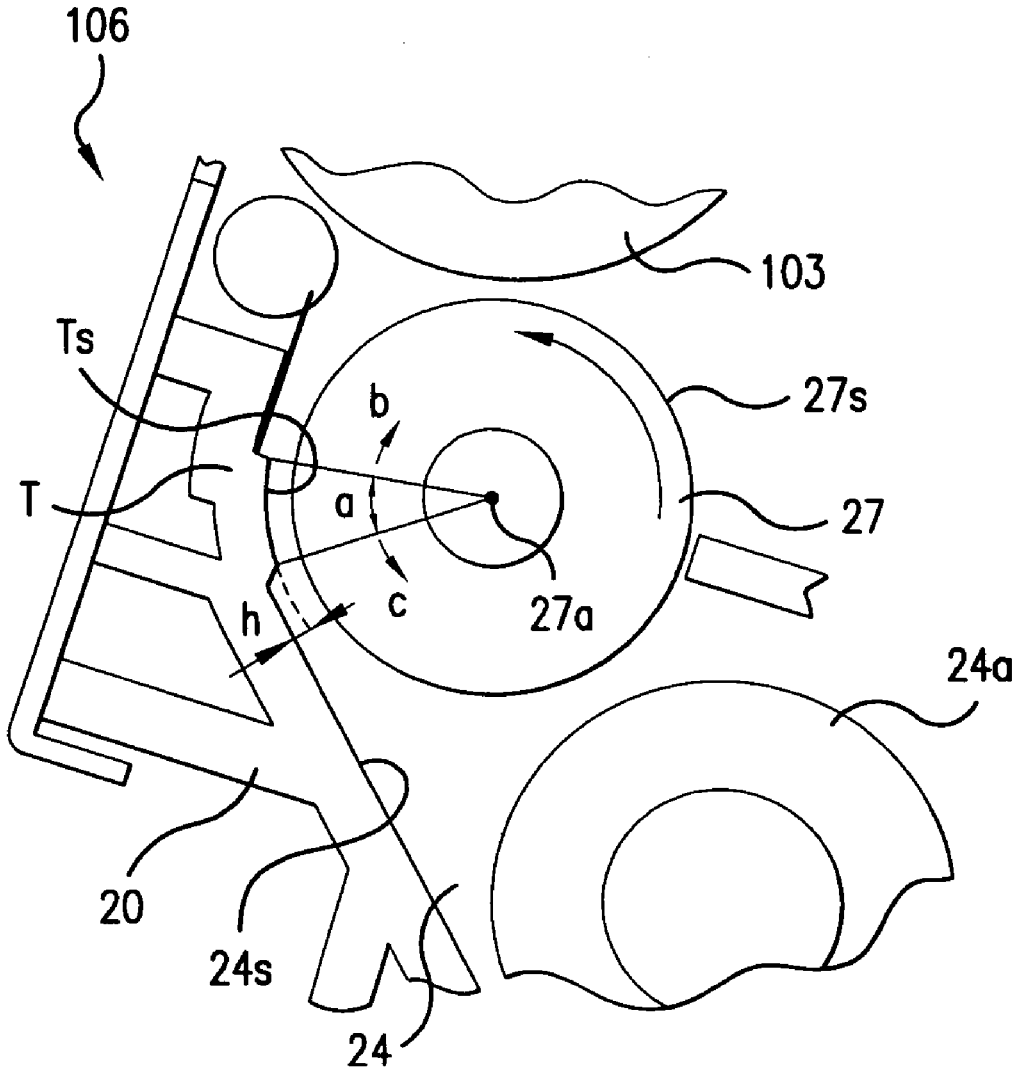
FIG. 2 is an enlarged view showing the developing device and its periphery within the image forming apparatus.

FIGS. 1 and 2 are schematic section views illustrating a developing device and an image forming apparatus equipped with the developing device according to an embodiment of the present invention. In these drawings, like parts similar in functions to those of the Figures are labeled with corresponding numerals.

In proximity to the circumference of a photosensitive drum 103 in the image forming apparatus according to the embodiment of the present invention, there are disposed: an electrical charger 104; an exposure portion (not shown); a developing device 106; a transfer portion 111; a fresh-toner supply portion 115; and a cleaner portion 116.

The photosensitive drum 103 is configured to have a photosensitive body as an outer circumferential surface thereof. When the entire photosensitive body (photosensitive surface) remains evenly at a predetermined electrical potential, regions thereon are varied in electrical potential by applying an optical irradiation onto those regions, as a result of which an electrical latent image is formed and kept for a predetermined period of time. A rotational axis of the photosensitive drum 103 is arranged to extend perpendicular to a sheet surface of FIG. 1.

The electrical charger 104 functions to charge a surface of the photosensitive drum 103 (photosensitive surface) at a predetermined electrical potential.

The non-shown exposure portion functions to expose the photosensitive surface of the photosensitive drum 103 to a laser beam whose emission conditions can be modified based on an image signal. An (exposure) irradiation position of the laser beam by this non-shown exposure portion is located downstream of the electrical charger 104 along a moving direction of the photosensitive surface of the photosensitive drum 103.

The developing device 106 is disposed downstream of the exposure irradiation position along the moving direction of the photosensitive surface of the photosensitive drum 103 and accommodates therein a two-component developer composed of carrier and toner (Hereinafter, referred to simply as a "developer") so as to supply the developer to the photosensitive surface of the photosensitive drum 103 by a developing roller 27. In this manner, the electrostatic latent image formed on the photosensitive surface of the photosensitive drum 103 is made visible for forming the toner image thereon. The developing device 106 also comprises a magnetic sensor 21 for detecting a toner specific concentration.

The transfer portion 111 functions to charge at a predetermined electrical potential a sheet on which any image will be formed and functions to transfer the toner image formed on the photosensitive drum 103 to the sheet.

The fresh-toner supply portion 115 functions to, at a predetermined timing, supply the developing device 106 with new toner which has not yet been used for forming any image based on a detection signal (corresponding to the toner specific concentration) from the magnetic sensor 21.

Along the moving direction of the photosensitive surface of the photosensitive drum 103 is the cleaner portion 116 disposed downstream of a transfer position at which the photosensitive drum 103 and the transfer portion 111 confront each other and functions to recover residual toner remaining on the photosensitive surface after the transferring process performed by the transfer portion 111.

Also, along the moving direction of the photosensitive surface of the photosensitive drum 103 is the electrical charger 104 disposed upstream of a developing position at which the photosensitive surface and the developing device 106 confront each other while the transfer portion 111 and the cleaner portion 116 in this order are disposed downstream of that developing position.

The fresh-toner supply portion 115 comprises a fresh-toner cartridge 115*a* for accommodating therein fresh toner and a supply roller 115*b* which is rotated at a predetermined timing by a non-shown motor to supply the fresh toner in the developing device 106.

The developing device 106 comprises: a developer vessel 20 for accommodating therein the developer; and the magnetic sensor 21 for detecting the concentration of toner accommodated in the developer vessel 20. The magnetic sensor 21 is disposed at a lower portion of the developer vessel 20.

The developing vessel 20 includes spaces (such as a first chamber 24, a second chamber 25, and a third chamber 26) partitioned by first and second partitions 22 and 23 each having a predetermined length in a direction parallel to the rotational axis of the photosensitive drum 103. The predetermined length of each partition is designed such that adjacent spaces of the first and second chambers 24 and 25 in the vicinity of opposite ends of that partition in its longitudinal direction can communicate with each other. The first, second and third chambers 24, 25, 26 have therein first, second and third mixers 24*a*, 25*a*, 26*a*, respectively, each having a rotational axis substantially parallel to the rotational axis of the photosensitive drum 103.

Particularly, in the first chamber 24, there is disposed the developing roller 27 that confronts the photosensitive surface of the photosensitive drum 103 at the developing position (at which the toner is passed to that photosensitive surface from the developing device 106) and is rotatable about a rotational axis serving as a center for rotation and arranged substantially parallel to the rotational axis of the photosensitive drum 103.

With this configuration, the toner is agitated in each of the first, second and third chambers 24-26 by the first, second and third mixers 24*a*-26*a* and transported in a direction perpendicular to the sheet surface of FIG. 1.

The toner recovered at the cleaner portion 116 is transported to the third chamber 26 of the developing device 106 by a non-shown toner transporting mechanism.

On the other hand, a fresh toner supply part (invisible in FIG. 1) to which new toner is resupplied or replenished from the fresh toner supply portion 115 is disposed in the vicinity of the end of the second chamber 25 in its longitudinal direction.

The third mixer 26*a* receives both recycle toner (or recovered-toner) from the cleaner portion 116 and the developer transported through the second chamber 25 by the second mixer 25*a* and passes them to the second mixer 25*a* while they are agitated by the third mixer 26*a*. The second mixer 25*a* receives the developer from the third mixer 26*a* and the first mixer 24*a* and new toner through the non-shown fresh toner supply part from the fresh toner supply portion 115, and then transports them while agitating them to pass them to the first mixer 24*a*. The first mixer 24*a* passes the developer received from the second mixer 25*a* while agitating it to the developing roller 27, and passes to the second mixer 25*a* the developer which is held on the roller surface of the developing roller 27 and has already been used for the developing process.

Thereafter, the recycle toner which has already experienced developing and transferring processes is recovered from the photosensitive surface of the photosensitive drum 103 by the cleaner portion 116 and reused in the developing device 106.

More specifically, the developing roller 27 is configured to hold the developer on its roller surface by magnetic force.

The magnetic force is distributed on the roller surface along a circumferential direction thereof so as to be strong at a position (i.e., in vicinity of the developing position confronting the photosensitive drum 103) where the retention of the developer is required and so as to be weak at a position (a so-called "recovery pole") where the developer that is residual on the roller surface after the developing process should be disengaged from the roller surface.

With this configuration, the developer remaining on the roller surface of the developing roller 27 after the developing process is dropped downwardly by gravity as it moves to approach the position at which the magnetic force on the roller surface is weak. The resultant dropped developer is gradually accumulated in the first chamber 24 (serving as a toner recovery vessel) of the developer vessel 20. Then, the accumulated developer is passed to the second mixer 25*a* as being agitated by a first mixer 24*a*.

According to the embodiment of the present invention, a portion which is located on an inner wall of the developer vessel (especially, a position W as shown in FIG. 1) and on which the residual toner is easily deposited is shaped such that it makes difficult for the toner to deposit on it, thereby suppressing to generation of the toner-clump.

Specifically, the developing device 106 is designed to arrange the developing roller 27 to face an interior the first chamber 24 serving as the toner recovery vessel of the developer vessel 20, and allows the developing roller 27 to rotate (in a direction of an arrow as shown in FIG. 1) while being retentive of the toner in the first chamber 24 due to its magnetic force for supplying the toner to the photosensitive surface of the photosensitive drum 103 and to recover its retentive toner remaining on the developing roller 27 by the first chamber 24. At an inner wall part (i.e., in the vicinity of the position W as shown in FIG. 1) which confronts a roller surface 27*s* of the developing roller 27 and where the toner begins to drop from the developing roller 27 into the first chamber 24 during rotation thereof, there is a protrusion portion T which is protruded toward the roller surface.

In detail, the developing device 106 according to this embodiment comprises: a developing roller adapted for holding the toner while being rotated and for supplying the toner to a surface of a photosensitive body; and a toner recovery vessel adapted for orienting the developing roller to face an opening portion of the toner recovery vessel, supplying the developing roller with the toner to be held thereon and recovering the toner residual on the developing roller, and the toner recovery vessel further including a protrusion portion T which is protruded toward the roller surface at the inner wall part confronting a roller surface of the developing roller and where the toner begins to drop from the developing roller during rotation thereof.

In this embodiment, the protrusion portion T which is disposed on an inner wall surface 24*s* of the first chamber 24 is shaped into a projection extending substantially in a direction parallel to a rotational axis of the developing roller 27. The protrusion portion T thus formed above is provided on a predetermined region of the inner wall 24*s* of the first chamber 24 and has a protruding surface Ts which is spaced a predetermined distance from the roller surface 27*s* of the developing roller 27. These predetermined region and predetermined distance will be described in detail later on.

Figure 3:
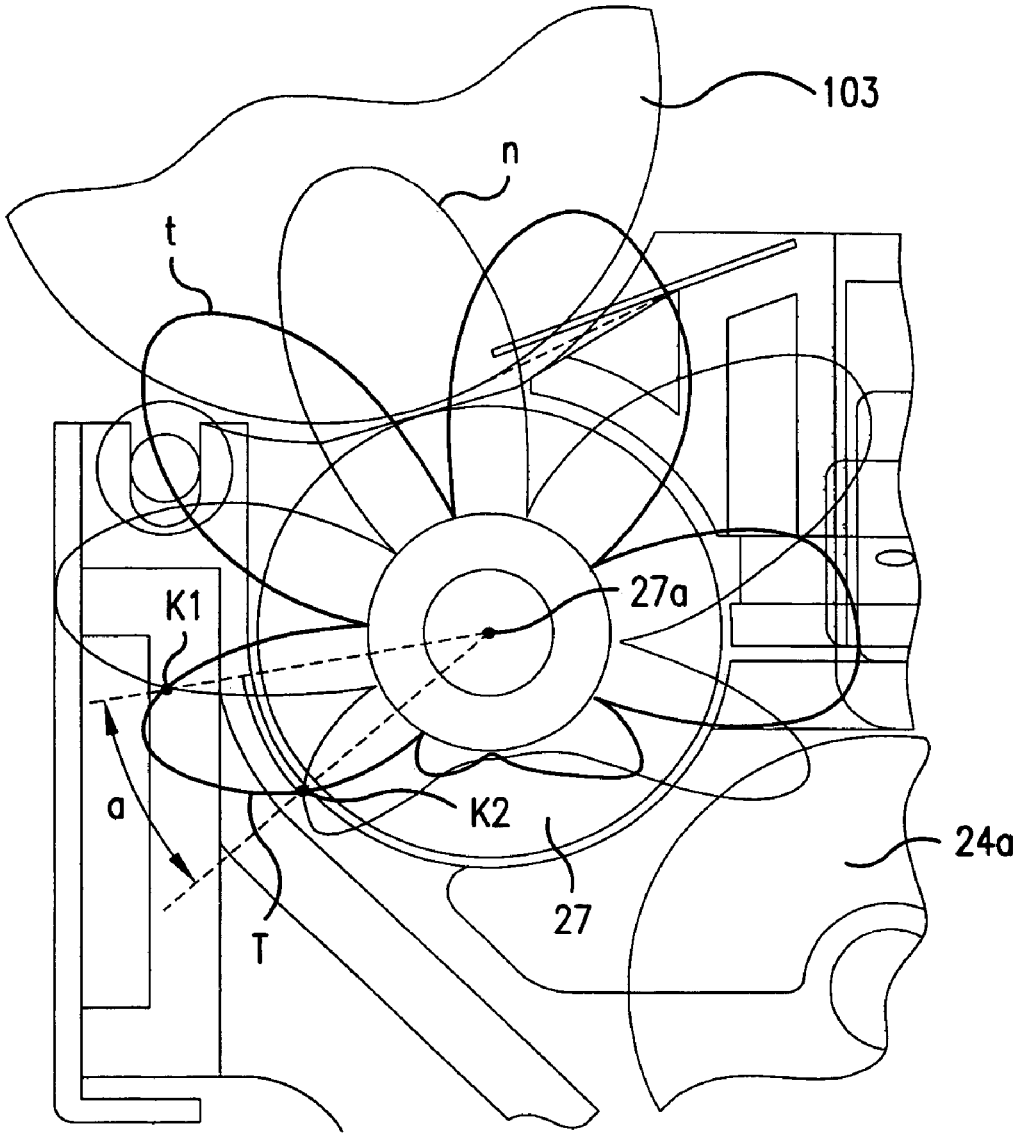
FIG. 3 is an enlarged view showing the developing device and its periphery within the image forming apparatus, especially illustrating a relationship between magnetic force of a developing roller and a protrusion portion T.
Figure 6:
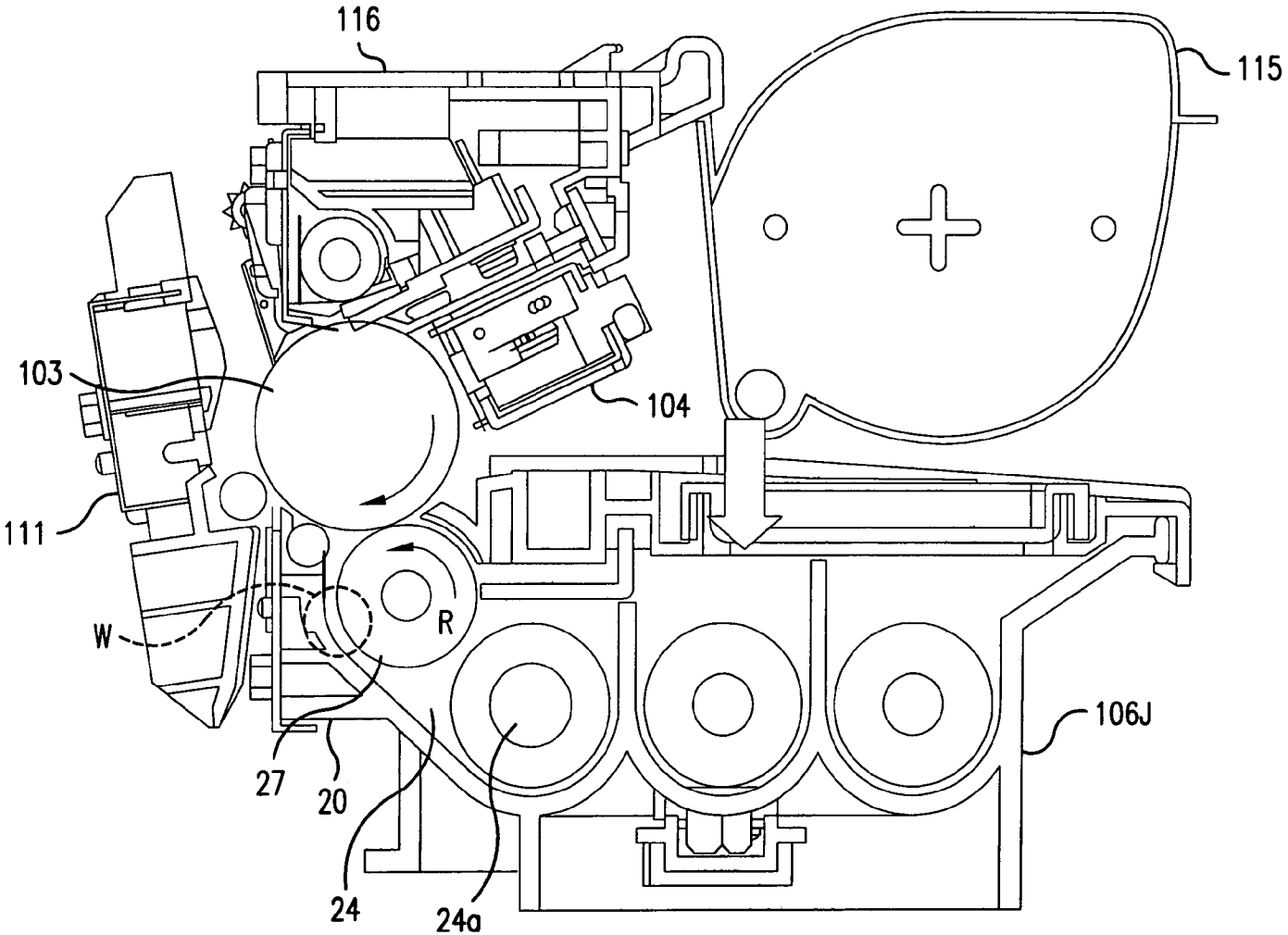
FIG. 6 is schematic diagram illustrating an internal configuration of the traditional image forming apparatus.

FIG. 3 is an enlarged view illustrating a relationship between the magnetic force of the developing roller and the protrusion portion T.

The developing roller 27 comprises a plurality of magnetos arrayed along the rotational direction of the developing roller 27 for holding the toner thereon. Due to the magnetic force, its components (values) tangential to the roller surface 27*s* (tangential direction components) which is on a plane substantially perpendicular to the rotational axis of the developing roller 27 are represented by a curve t and its components (values) normal to that roller surface 27*s* (normal direction components) are represented by a curve n, respectively, as shown in FIG. 3.

As shown in FIG. 3, the magnetic force of the developing roller 27 is set so as to be strong at an angular position where it is necessary to hold the toner on the roller surface 27*s* of the developing roller 27 and so as to be weak at a position where it is unnecessary to hold the residual toner remaining on the roller surface 27*s* after the developing process.

With this configuration, the residual toner remaining on the roller surface 27*s* of the developing roller 27 after the developing process begins to be dropped downwardly at or near a position where the gravity acting on the residual toner is larger than the retention force for holding the residual toner on the roller surface 27*s*, thereby sliding down the inner wall 24*s* of the first chamber 24 into that first chamber 24 for recovery.

In particular, it should be noted that the protrusion portion T in the developing device according to this embodiment is provided on the inner wall part of the first chamber 24 (the toner recovery vessel) and located at the position where the residual toner begins to drop into the toner recovery vessel. More specifically, the inner wall part is a predetermined region which includes a part or all of an angular range about a rotational center 27*a* of the developing roller and spans between intersections (K1, K2 of FIG. 3) of two kinds of curves, one of which represents tangential direction components of the magnetic force with respect to the roller surface 27*s* which is on a plane substantially perpendicular to the rotational axis of the developing roller 27 and the other of which represents the normal direction components of the magnetic force with respect to that roller surface 27*s*.

FIGS. 4 and 5 are tables each for explaining the influence on the picture quality of an image formed on a sheet upon variations of the protruding amount and the protruding width of the protrusion portion T.

FIG. 4 illustrates the picture quality of the image formed on the sheet when a range of the protruding amount as shown in FIGS. 1 and 2 is varied. In FIG. 4, a lower end of the protrusion portion T (see FIGS. 2 and 3) is set at or near a position on a line passing through the rotational center 27*a* of the developing roller and the intersection K2 while an upper end of the protrusion portion T is expanded in a direction of b. In the table of FIG. 4, a protruding amount h (mm) (of the protruding surface Ts of the protrusion T) on a left side of the table represents an amount of protrusion from the inner wall 24*s* of the first chamber 24. A protruding width (°) on an upper side of the table represents an angular expanding amount of the upper end of the protrusion portion T about the rotational center 27*a* of the developing roller. It should be noted that the direction of b means a positive direction for increasing a region of the protrusion portion T.

FIG. 5 illustrates the picture quality of the image formed on the sheet when the range of the protruding amount is varied. In FIG. 5, the upper end of the protrusion portion T (see FIGS. 2 and 3) is set at or near a position on a line passing through the rotational center 27*a* of the developing roller and the intersection K1 while the lower end of the protrusion portion T is expanded in a direction of c. In the table of FIG. 5, the protruding amount h (mm) (of the protruding surface Ts of the protrusion T) on the left side of the table represents the amount of protrusion from the inner wall 24*s* of the first chamber 24. The protruding width (°) on the upper side of the table represents an angular expanding amount of the lower end of the protrusion portion T about the rotational center 27*a* of the developing roller. It should be noted that the direction of c means a positive direction for increasing the region of the protrusion portion T.

In FIGS. 4 and 5, a symbol "○" indicates that no problem occurs on the image formed on the sheet, a symbol "x" indicates a soil occurred on that image; a symbol "|" indicates a faulty dragging-in of the residual toner to be recovered into the first chamber 24 due to an excessively narrow spacing between the protruding surface of the protrusion portion T and the roller surface; a symbol "□" indicates a medium state between the states of "○" and "x"; and a symbol "▲" indicates a mixer impression occurred on the image formed on the sheet.

As is clear from the foregoing, if the spacing between the protruding surface Ts of the protrusion portion T and the roller surface 27*s* of the developing roller 27 is wide to excess, an advantageous effect yielded by existence as a protrusion portion is low (i.e., it is more difficult to prevent the toner-clump from being generated). On the contrary, if that spacing is narrow to excess, some problems such as the faulty dragging-in of the developer (e.g., a droppage of the developer into an interior of the machine) and the mixer impression occurred on the image. Therefore, it is preferable that spacing is set so as not to rise such problems (without obstructions to the droppage of the residual toner into the first chamber 24).

FIGS. 4 and 5 shows results of experiments conducted on the developing device in the case of the spacing of about 2 mm between the roller surface 27*s* of the developing roller 27 and the inner wall 24*s* of the first chamber 24. Accordingly, for example, since a high picture quality is obtainable by the protruding amount of 0.7 mm when the protruding width spans 10° (the region of the protrusion portion T is expanded in the direction of b over 10°), it can be clarified that the spacing between the protruding surface Ts of the protrusion portion T and the roller surface 27*s* of the developing roller 27 is preferably 2.0–0.7=1.3 (mm) in the case of the protruding width of 10°. That is, according to this example, a predetermined spacing between the protruding surface Ts and the roller surface 27*s* is approximately 1.3 (mm) so that the droppage of the residual toner into the first chamber 24 is not obstructed.

Of course, the above-mentioned specific spacing is merely an example but is not limited to according to the present invention, and therefore any other spacing may be available if they can satisfy the requirement to implement the state "○" in which no problems occurs on the image formed on the sheet.

In the embodiment as described above, the region in which the protrusion portion T is provided on the inner wall 24*s* of the first chamber 24 is set in an angular range a of +5° about the rotational center 27*a* of the developing roller between intersections (K1, K2 of FIG. 3) of two kinds of curves, one of which represents tangential direction components of the magnetic force with respect to the roller surface 27*s* and the other of which represents the normal direction components of the magnetic force with respect to that roller surface 27*s*. Thus, since a place at which the toner-clump tends to be deposited is located between the poles of the magnetos disposed in the developing roller, it is preferable that a range along which the spacing between the roller surface 27*s* and the inner wall part of the developing vessel 20 should be narrower than the other is set to be within an angular range from an intersection of the normal direction magnetic force and the tangential direction magnetic force to +5°.

Further, in the embodiment as described above, a spatial region in which the toner-clump tends to deposit, i.e., a part of a spacing provided between the developing roller 27 and a barb (position W in FIG. 1) of the inner wall 24*s* of the first chamber 24 is set to be narrower than the other along the roller surface 27*s* rotated about the rotational axis of the developing roller 27. In particular, that part is configured by shaping the protrusion portion T in the form of a step in a sectional view thereof but is not limited to according to the present invention. For example, it is available to smoothly protrude the inner wall 24*s* partially, thereby forming the protruding surface Ts similar to the protrusion T consequentially.

As described above, the developing device according to the embodiment of the present invention defines a narrow range of the gap between a barb of a wall surface of a toner recovery vessel and a developing roller, and sets the narrow range of the gap to a part between at least magnetic poles for toner recovery (located on the developing roller and at positions at which respective magnetic forces are weak for holding the toner). Thus, the gap between the barb and the developing roller is defined to be narrow between the magnetic poles for toner recovery so that foreign substances (toner-clumps, pager dusts or the like) are prevented from being deposited on the barb to obstruct the toner-clumps and the like from being mixed into any other normal toner in the toner recovery vessel. As a result, it is advantageously possible to prevent the deterioration in picture quality.

Further, in the embodiment as described above, the developing device is an upward type one but is not limited to according to the present invention. The present invention is also applicable to a lateral type of the developing device.

Furthermore, the developing device according to the embodiment as described above can be loaded into an image forming apparatus that renders the developing process by the developing device to a photosensitive body. For example, such an image forming apparatus comprises: the developing device as described above; a photosensitive body having a photosensitive surface on which a toner image is formed by the developing device; and a transfer portion adapted for transferring the toner image formed on the photosensitive surface to a sheet.

According to the present invention, a sheet available in conjunction with the developing device is not limited to a copying paper, but may include a variety of sheets such as an OHP sheet.

According to the present invention, the toner-clumps are prevented from being deposited on the barb of the developing device so that a soil on that image occurred during loading/unloading of the developing device into the image forming apparatus can effectively be obstructed, thereby securing the high-quality images.

In general, there remains the residual toner on the photosensitive surface of the photosensitive drum after it has passed through the transferring process. This residual toner is removed from the photosensitive surface of the photosensitive drum by any cleaning member. If a toner recycle technology is employed, the residual toner which has been removed from the photosensitive surface by using the cleaning member is transported into the developing device by the toner transporting mechanism and again supplied therefrom onto the developing roller. Such a residual toner (recycle toner) is generally subjected to various stresses such as pressure and the like during a cleaning process and a transporting process. Due to this reason, the toner itself deteriorates or an externally added agent adhered to the toner particles exfoliates (or separates) from the toner particles so as to readily lower toner fluidity. If the toner thus mentioned above is again employed, it will readily cause the toner-clumps on the barb due to its low fluidity. However, it is possible to prevent the toner-clumps from being deposited on the barb of the developing device according the present invention.

As described above, it is possible to provide a developing device adapted to suppress the deterioration of in picture quality of an image formed on a sheet due to toner-clumps created in a developer vessel, as well as an image forming apparatus equipped with that developing device.

Although the present invention has been described herein with respect to particular features, aspects and one embodiment thereof, it will be apparent that numerous variations, modifications, and other embodiments are possible within the broad scope of the present invention, and accordingly, all variations, modifications and embodiments are to be regarded as being within the scope of the invention. The present embodiment is therefore to be construed in all aspects as illustrative and not restrictive and all changes coming within the meaning and equivalency range of the appended claims are intended to be embraced therein.

What is claimed is:

1. A developing device, comprising:

a developing roller adapted to hold toner thereon while rotating and to supply the toner onto a photosensitive surface of a photosensitive body;

a toner recovery vessel adapted to accommodate said developing roller therein with facing an opening portion thereof and to supply the toner to be held on said developing roller onto said developing roller while recovering residual toner remaining on said developing roller; and said toner vessel including a protrusion portion protruded toward a roller surface of said developing roller, said protrusion portion being provided at an inner wall part which confronts said roller surface of said developing roller in a non-contact manner and where the residual toner begins to drop from the developing roller.

2. A developing device as claimed in claim 1, wherein said developing roller is able to hold the toner on said roller surface by magnetic force; and wherein said protrusion portion is provided on the inner wall part of said toner recovery vessel and located at a position where the residual toner begins to drop into said toner recovery vessel, said inner wall part being in a predetermined region which includes a part or all of an angular range about a rotational center of said developing roller and spans between intersections of two kinds of curves, one of which represents tangential direction components of the magnetic force with respect to said roller surface which is on a plane substantially perpendicular to a rotational axis of said developing roller and the other of which represents the normal direction components of the magnetic force with respect to said roller surface.

3. An image developing device as claimed in claim 1, wherein a spacing between said protrusion portion and said roller surface of said developing roller is set to a distance by which the droppage of said residual toner into said toner recovery vessel is not obstructed.

4. An image developing as claimed in claim 1, wherein said protrusion portion is shaped into a projection extending substantially in a direction parallel to a rotational axis of the developing roller.

5. An image forming apparatus, comprising:

said developing device as claimed in claim 1;

a photosensitive body having a surface on which a toner image is formed by said developing device; and a transferring portion adapted for transferring the toner image formed on the surface of the photosensitive body onto a sheet.

6. An image forming apparatus as claimed in claim 5, wherein said developing roller is able to hold the toner on said roller surface by magnetic force; and wherein said protrusion portion is provided on the inner wall part of said toner recovery vessel and located at a position where the residual toner begins to drop into said toner recovery vessel, said inner wall part being in a predetermined region which includes a part or all of an angular range about a rotational center of said developing roller and spans between intersections of two kinds of curves, one of which represents tangential direction components of the magnetic force with respect to said roller surface which is on a plane substantially perpendicular to a rotational axis of said developing roller and the other of which represents the normal direction components of the magnetic force with respect to said roller surface.

7. An image forming apparatus as claimed in claim 5, wherein a spacing between said protruding portion and said roller surface of said developing roller is set to a distance by which the droppage of said residual toner into said toner recovery vessel is not obstructed.

8. An image forming apparatus as claimed in claim 5, wherein said protrusion portion is shaped into a projection extending substantially in a direction parallel to a rotational axis of the developing roller.

* * * * *